US006666367B1

(12) United States Patent
Ohnesorge et al.

(10) Patent No.: US 6,666,367 B1
(45) Date of Patent: Dec. 23, 2003

(54) COMPONENT PROCESSING CENTER

(75) Inventors: David Ohnesorge, Columbia, MO (US); Jason Gregory, Columbia, MO (US)

(73) Assignee: Mitek Holdings, Inc., Wilmington, DE (US)

( * ) Notice: Subject to any disclaimer, the term of this patent is extended or adjusted under 35 U.S.C. 154(b) by 30 days.

(21) Appl. No.: 10/094,917

(22) Filed: Mar. 11, 2002

(51) Int. Cl.[7] ..... B27F 4/00

(52) U.S. Cl. ..... 227/100; 227/99; 227/101; 227/105; 227/110

(58) Field of Search ..... 227/7, 45, 50, 227/99, 100, 101, 110, 105, 152

(56) References Cited

U.S. PATENT DOCUMENTS

| | | | | |
|---|---|---|---|---|
| 2,111,081 | A | | 3/1938 | Taylor |
| 2,456,221 | A | | 12/1948 | Stilwell et al. |
| 2,544,499 | A | * | 3/1951 | Hovey ..... 227/153 |
| 3,086,210 | A | * | 4/1963 | Good et al. ..... 227/99 |
| 3,090,961 | A | | 5/1963 | McRae et al. |
| 3,552,624 | A | | 1/1971 | Dykeman |
| 3,557,439 | A | | 1/1971 | Dykeman |
| 3,755,871 | A | * | 9/1973 | Nelson, Jr. ..... 29/430 |
| 3,765,587 | A | * | 10/1973 | Davis ..... 227/100 |
| 3,968,560 | A | | 7/1976 | Vial |
| 4,039,112 | A | * | 8/1977 | Schultz ..... 227/40 |
| 4,133,097 | A | | 1/1979 | Slade |
| 4,204,624 | A | * | 5/1980 | Gunn et al. ..... 227/45 |
| 4,305,538 | A | | 12/1981 | Schultz et al. |
| 4,867,819 | A | | 9/1989 | Richardelli et al. |
| 4,876,787 | A | * | 10/1989 | Ditty et al. ..... 29/430 |
| 5,058,795 | A | | 10/1991 | Tonus |
| 5,058,819 | A | | 10/1991 | Lacour |
| 5,646,860 | A | | 7/1997 | Greiner et al. |
| 5,727,301 | A | | 3/1998 | Kugo |
| 6,089,434 | A | | 7/2000 | Gleason |

* cited by examiner

*Primary Examiner*—Scott A. Smith
*Assistant Examiner*—Chukwurah Nathaniel
(74) *Attorney, Agent, or Firm*—Senniger, Powers, Leavitt & Roedel

(57) ABSTRACT

Apparatus having automated loading 15, nailing 22, and stacking 24 areas for wood components, wall panels or wall components is described. The apparatus includes a control panel 14 that allows automated selection 94 of the type of sub-component to be handled, the speed 98 at which the nailing and stacking operation is executed, the compression rate 100 in which the operation is executed and provides automated feedback 106 of the progress of the operation. A guide track 30, stationary 26 and powered 28 compression members and side conveyer belts 16 that work in conjunction with upper 18 and side 20 rollers allow for positioning, clamping, and movement of the raw material 70 into the nailing stage 22 of the operation. The rollers allow for the nailing process 22 before being moved to the stacking system 24.

30 Claims, 15 Drawing Sheets

COMPONENT PROCESSING CENTER

BACKGROUND OF THE INVENTION

1. Field of the Invention

The present invention relates generally to assembling of wood products and, more specifically, to automated nailing and stacking of wood components, wall panels, or wall components.

The present invention includes a control panel that allows for means of automated selection for type of sub-component to be fastened, automated selection control of the speed in which the nailing and stacking operation is executed, automated selection control of the compression rate in which the operation is executed, automated selection control of the nailing setting. In addition to automated feedback of the progress of the operation.

The present invention includes a front end guide track, stationary and powered compression members and a plurality of side conveyer belts that work in conjunction with upper and side rollers that allows for positioning, clamping, and movement of the raw material into the nailing stage of the operation. The upper and side rollers then allow for the nailing process before being moved to the stacking conveyer. The stacking stage includes a roller type conveyer with track mounted stacking arms that are used in conjunction with a plurality of pistons and a displacement bar to stack the sub-components as dictated by the setting on the automated control panel.

An alternate method of the front end of the machine utilizes a single chain down on the compression member in lieu of the side conveyer belts. The chain includes a stop attached that is used to square the product as well as push the product through the nailing process.

2. Description of the Prior Art

SUMMARY OF THE PRESENT INVENTION

The present invention discloses an apparatus having automated loading, nailing, and stacking areas for wood components, wall panels or wall components. The present invention includes a control panel that allows for means of automated selection for type of sub-component to be fastened, automated selection control of the speed at which the nailing and stacking operation is executed, automated selection control of the compression rate in which the operation is executed, automated selection control of the nailing setting in addition to automated feedback of the progress of the operation. The present invention includes a front end guide track, stationary and powered compression members and a plurality of side conveyer belts that work in conjunction with upper and side rollers that allows for positioning, clamping, and movement of the raw material into the nailing stage of the operation. The upper and side rollers then allow for the nailing process of the operation. The upper and side rollers then allow for the nailing process before being moved to the stacking system conveyer. The stacking stage includes a roller type conveyer with track-mounted stacking arms that are used in conjunction with a plurality of pistons and a displacement bar to stack the sub-components as dictated by the setting on the automated control panel. An alternate method of the loading area of the machine utilizes a single chain on the compression member in lieu of the side conveyer belts. The chain includes a squaring stop attached thereto that is used to square the product as well as push the product through the nailing process.

A primary object of the present invention is to provide better means for fastening structural members of wood products.

Another object of the present is to provide better means for sub-component stacking of wood products.

A further object of the present invention is to have means in which to move the clamped sub-component through the nail guns.

Yet another object of the present invention is to have automated selection control of structural members to be fastened.

Still yet another object of the present invention is to have automated selection control of the speed in which the structural members are to be fastened.

A further object of the present invention is to have automated selection control of the compression in which the structural members are to be fastened.

A yet further object of the present invention is to have automated selection control of the nail setting in which the structural members are to be fastened.

A still yet further object of the present invention is to have automated selection control of the stacking method in which the structural members are to be fastened.

Another object of the present invention is to have automated visual means in which to feedback progress of an operation while the structural members are being fastened.

Additional objects of the present invention will appear as the description proceeds.

The present invention overcomes the shortcomings of the prior art by providing a sub-component processing center that allows for a method of moving the clamped sub-component assembly through the nail guns.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention be fully understood, it will now be described, by way of example, with reference to the accompanying drawings in which.

DETAILED DESCRIPTION OF THE PREFERRED EMBODIMENT

The following discussion describes in detail one embodiment of the invention. This discussion should not be construed, however, as limiting the invention to those particular embodiments; practitioners skilled in the art will recognize numerous other embodiments as well. For a definition of the complete scope of the invention, the reader is directed to the appended claims.

Figure 1:
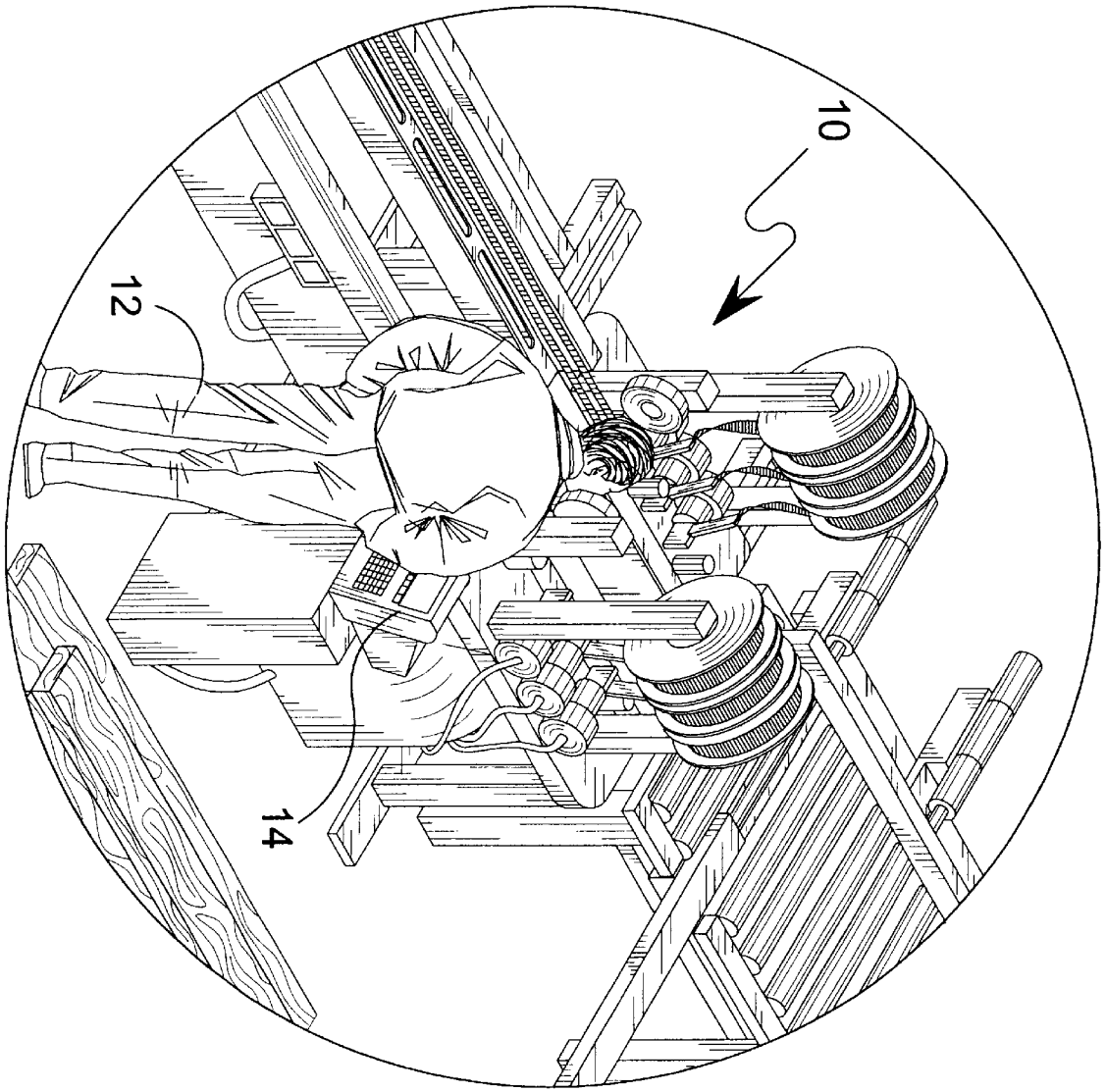
FIG. 1 is a perspective view of the present invention.

Turning to FIG. 1, shown therein is a perspective view of the present invention 10. Shown is the present invention 10 with a technician 12 programming the control panel 14 to the appropriate settings to control the timing of when the nails need to be fired into a work piece (not shown).

Figure 2:
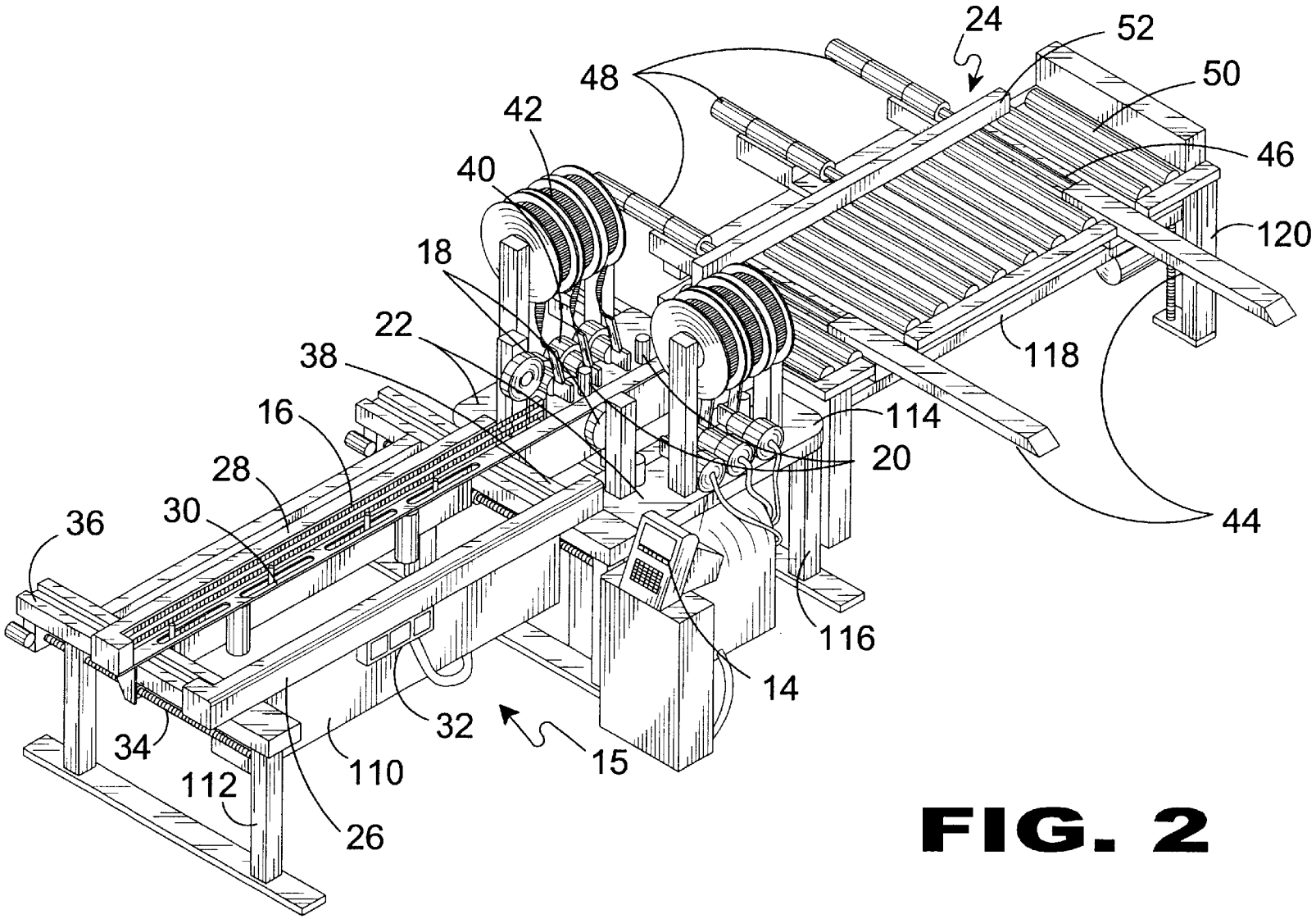
FIG. 2 is a perspective view of the present invention in use.

Turning to FIG. 2, shown therein is a perspective view of the present invention in use. Shown is the present invention 10 having a loading area 15, nailing system area 22 and stacking system 24. The loading area 15 has a plurality of side conveyer belts 16 that work in conjunction with the upper 18 and side 20 positioning rollers to produce movement of the raw material work piece past the nailing system areas 22 where nailing can take place and then be moved to the stacking system 24 where the finished product is stacked. Also shown is a horizontal stationary compression member 26 that cooperates with a movable parallel powered compression member 28 along with a guide track 30 having a guide control 32 along with a ball screw 34. Also shown is a control panel 14. The movable compression member 28 moves on tracks being a pair of parallel tracks 36, 38 which are also shown. Also shown is nail gun 40, nail supply 42, a pair of stacking arms 44 which move on a pair of stacking arm tracks 46 along with a plurality of pneumatic pistons 48; also shown are a plurality of rollers 50 and a displacement bar 52 which is powered by the pneumatic pistons 48 to move work pieces or products toward the stacking arms 44. Also shown are the support frame 110 with multiple legs 112 for the loading area 15, the frame 114 and legs 116 for the nailing system 22, and the frame 118 with legs 120 of the stacking system 24.

Figure 3:
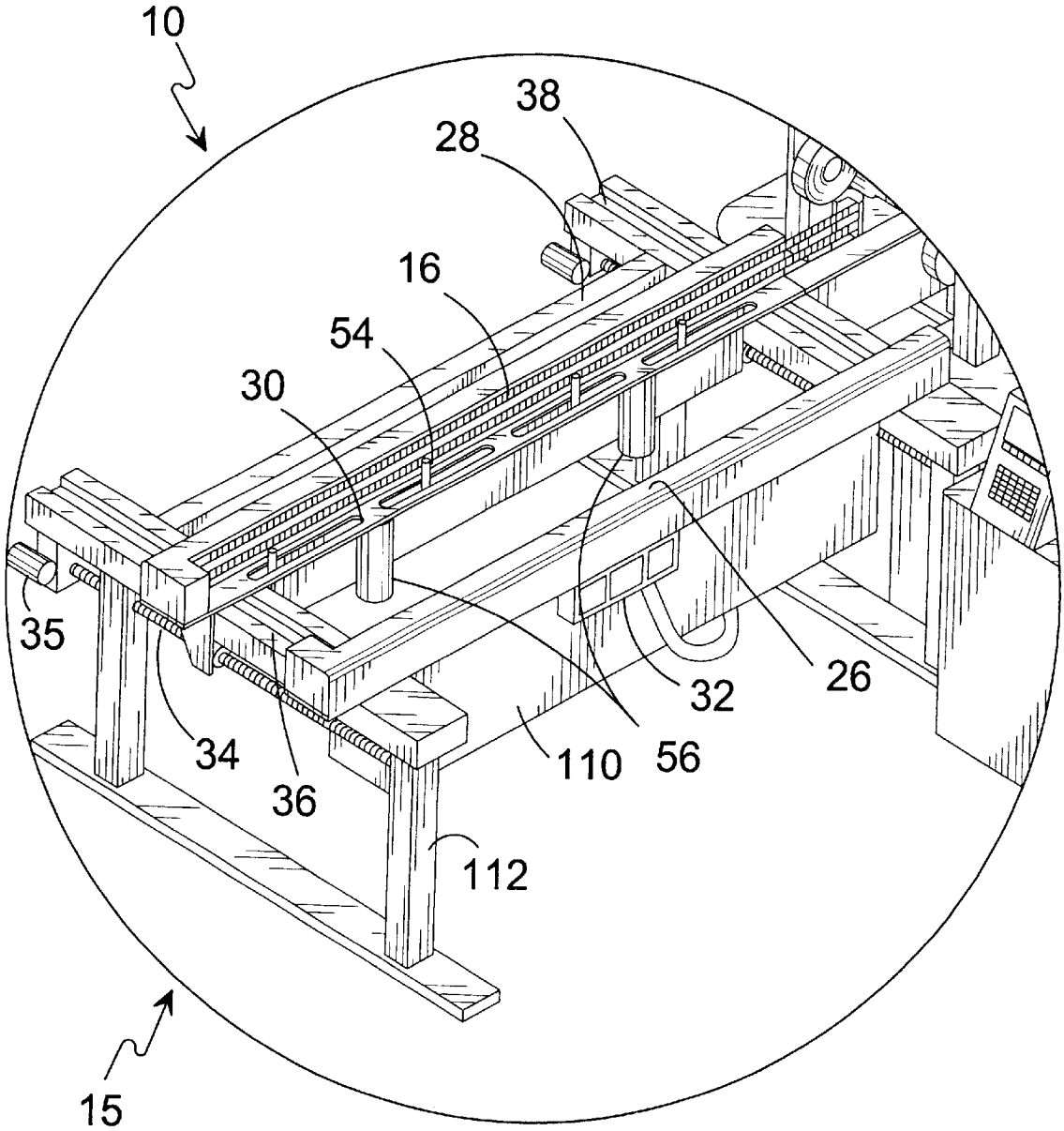
FIG. 3 is a detailed view of the present invention's loading area.

Turning to FIG. 3, shown therein is a detailed view of the present invention's 10 loading area 15. Shown in detail is the loading area 15 of the present invention having a stationary compression member 26 and a powered movable parallel compression member 28 that is powered by a ball screw 34 having motor means 35 thereon. Also shown are a pair of parallel compression member tracks 36, 38 that the powered compression member 28 may move along to compress raw materials placed on the guide track 30. Also shown are the multiple positioning guides 54, side conveyor belts 16, guide control 32, pneumatic cylinders 56 along with frame 110 and legs 112.

Figure 4:
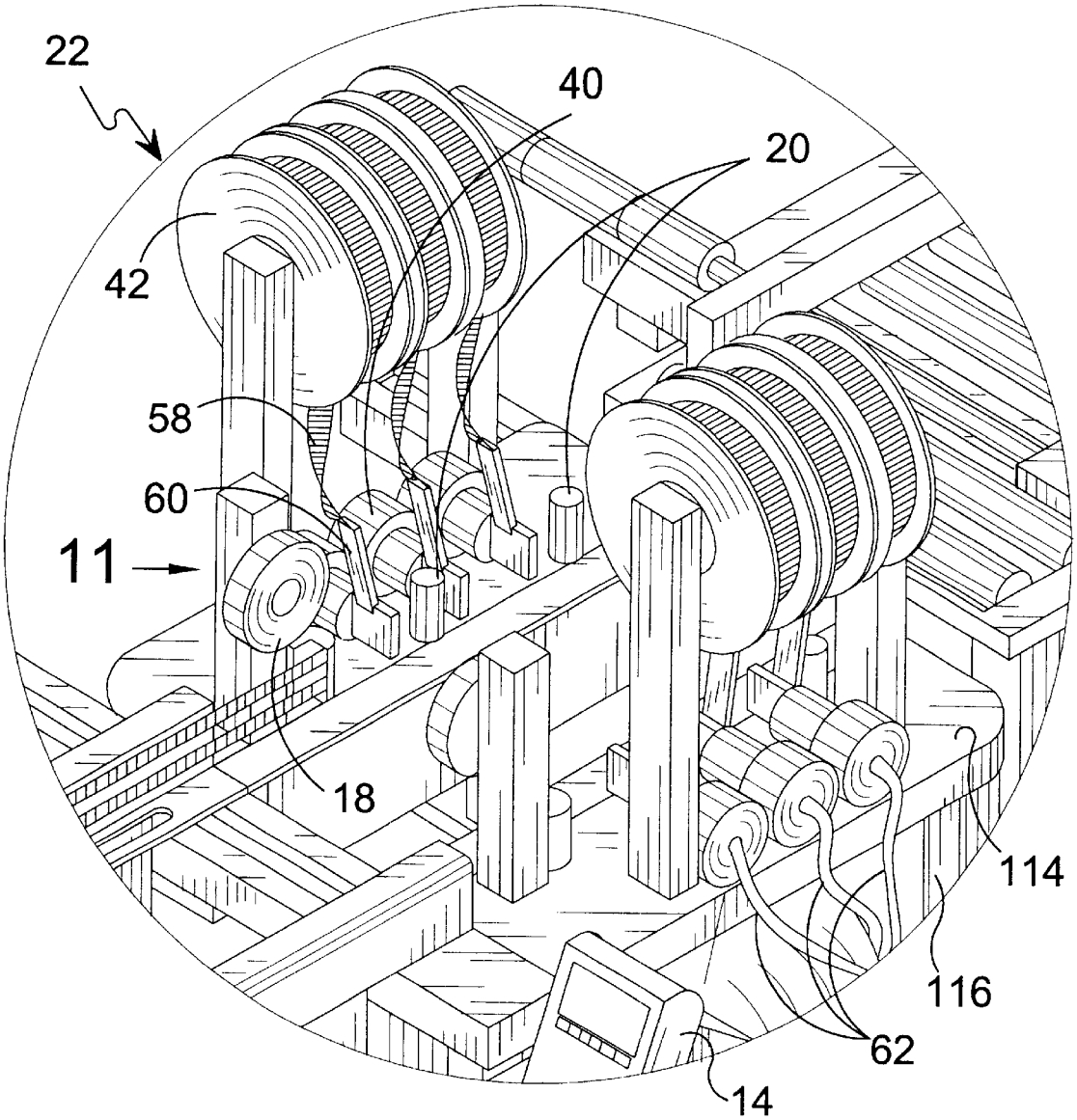
FIG. 4 is a detailed view of the present invention's nailing system.

Turning to FIG. 4, shown therein is a detailed view of the present invention's nailing system 22. Shown is the present invention having a plurality of nail guns 40 controlled by the control panel 14 to nail the raw materials together so that a finished product may be produced. Also shown are a plurality of upper 18 and side 20 positioning rollers to maintain raw material compression and positioning while the nailing process is executed. Also shown is the nail supply 42, nail belt 58, nail belt guide 60 and multiple air hoses 62 for operating the nail gun system 22. The support frame 114 and legs 116 are also shown.

Figure 5:
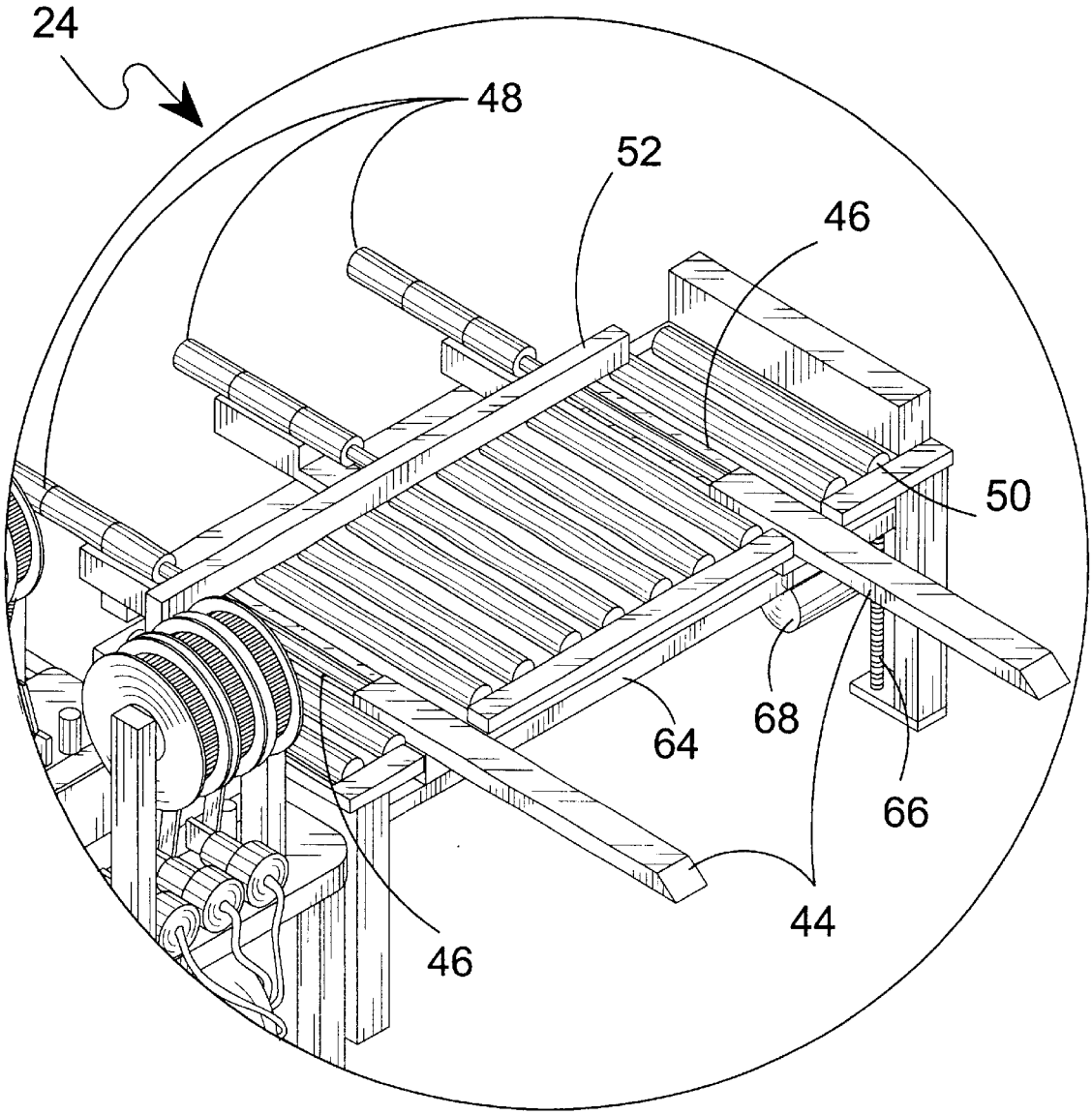
FIG. 5 is a detailed view of the present invention's stacking system.

Turning to FIG. 5, shown therein is a detailed view of the present invention's stacking system 24. Shown is the present invention having a horizontal movable displacement bar 52 for pushing the finished product onto the stacking arms 44 where it can then be lowered by the stacking table 64 powered by ball screws 66 and a motor 68. Also shown are a plurality of pneumatic pistons 48 to extend and retract the displacement bar 52 and stacking arms 44. Also shown are the stacking arm track 46 and rollers 50. The support frame 118 and legs 120 are also shown.

Figure 6:
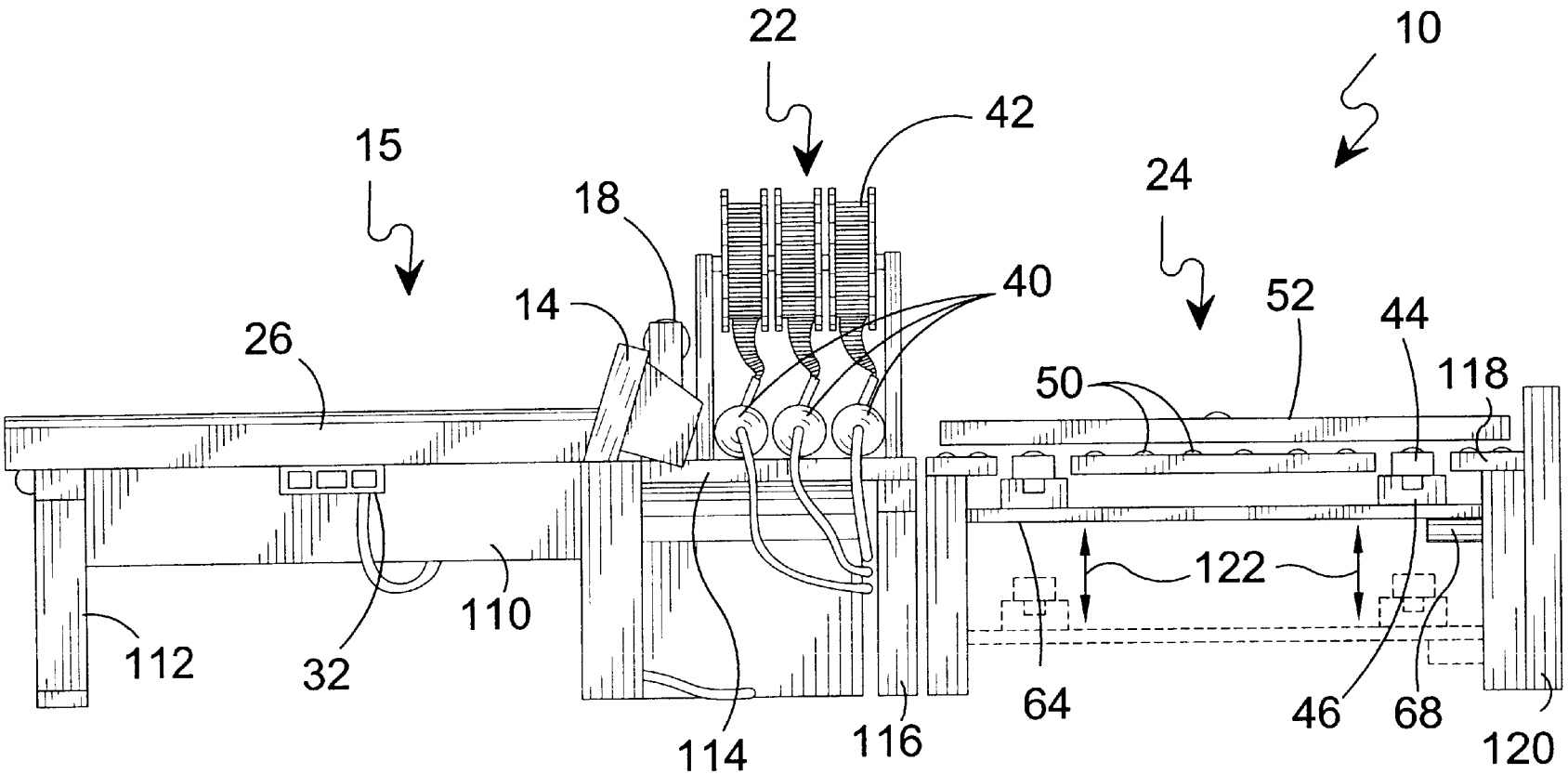
FIG. 6 is a side view of the present invention.

Turning to FIG. 6, shown therein is a side view of the present invention 10. Shown therein are the loading area 15 with frame 110 and legs 112, the nailing system 22 with frame 114 and legs 116 and the stacking area 24 with frame 118 and legs 120. The loading area has a stationary compression member 26 along with a guide control 32 and a control panel 14. Also shown is the upper positioning roller 18. Also shown is the nailing system 22 having a nail supply or source 42 along with a plurality of nail guns 40. Also shown is the stacking system 24 having a stacking table 64 with rollers 50 and displacement bar 52 powered by vertically mounted ball screws with a motor 68 to raise and lower (shown by arrows 122) the stacking arm table 64 and track 46 where the stacking arms 44 are attached so that lowering of the finished product into a stack is possible.

Figure 7:
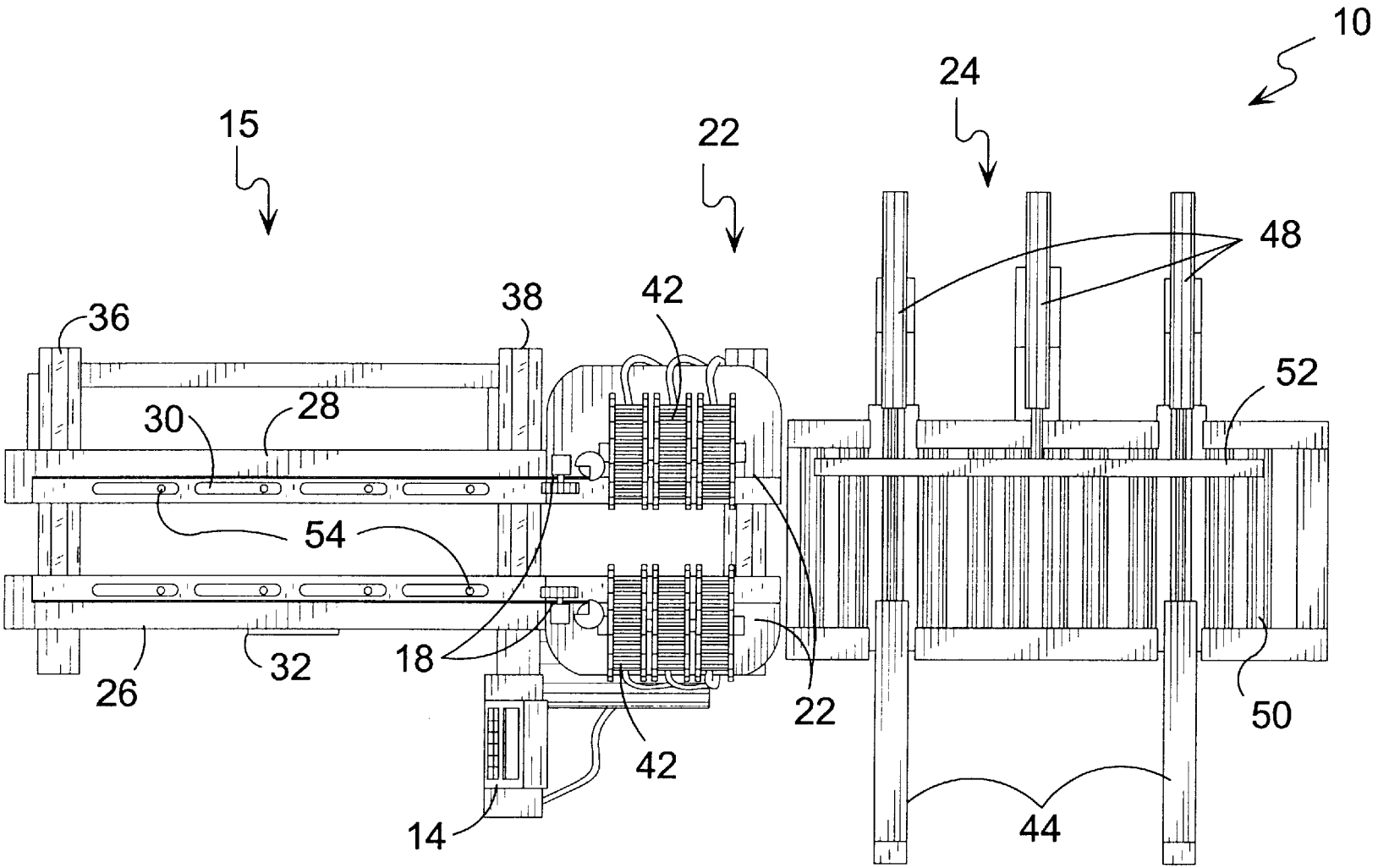
FIG. 7 is a top view of the present invention.

Turning to FIG. 7, shown therein is a top view of the present invention 10. Shown is the present invention 10 with a loading area 15, a nailing area 22 and stacking area. A stationary compression member 26 is shown to serve as a fixed surface and a powered compression member 28 mounted on tracks 36, 38 to push raw material against the stationary compression member 26 to create compression of the raw material between the two. Also shown are positioning guides 54 to aid in raw material placement on the guide track 30 that are manually raised and lowered by air cylinders that are activated by the guide control 32. Also shown is the upper positioning roller 18 along with the control panel 14. The nailing area 22 has shown a pair of nail sources 42 as previously disclosed. The stacking system 24 is shown having stacking arms 44 along with rollers 50, displacement bar 52 and pneumatic pistons 48 as previously explained.

Figure 8:
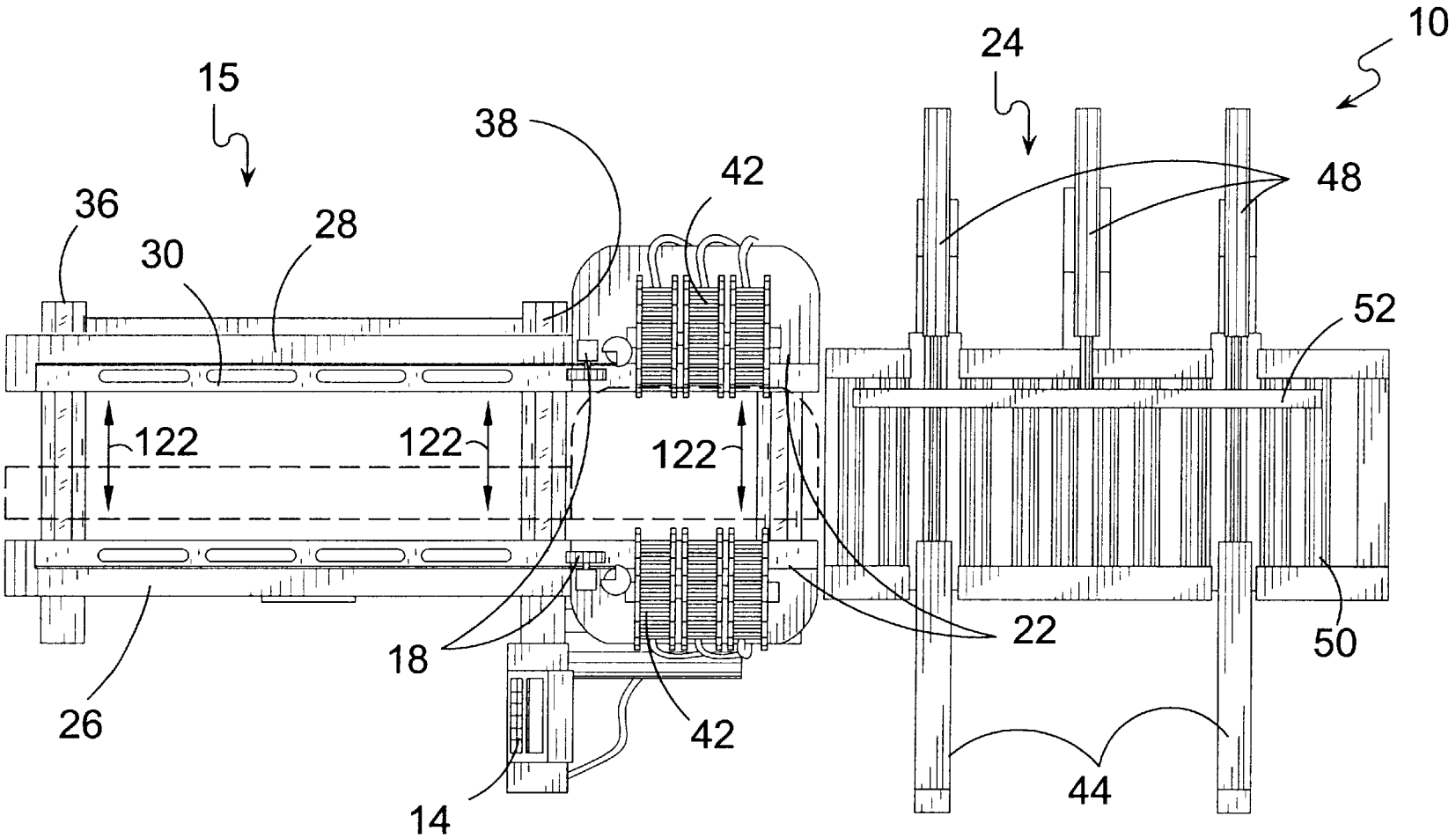
FIG. 8 is a side view of the present invention in operation.

Turning to FIG. 8, shown therein is a top view of the present invention 10 in operation. Shown is the present invention with its powered compression member 28 in motion (see arrows 122) with the movement being produced by the ball screws that are horizontally mounted beneath the compression member tracks 36, 38 powered by a motor. Also shown is how the nailing portion of the present invention is attached to and moves along (see arrows 122) with respect to the powered compression member 38. Other elements previously disclosed are also shown.

Figure 9:
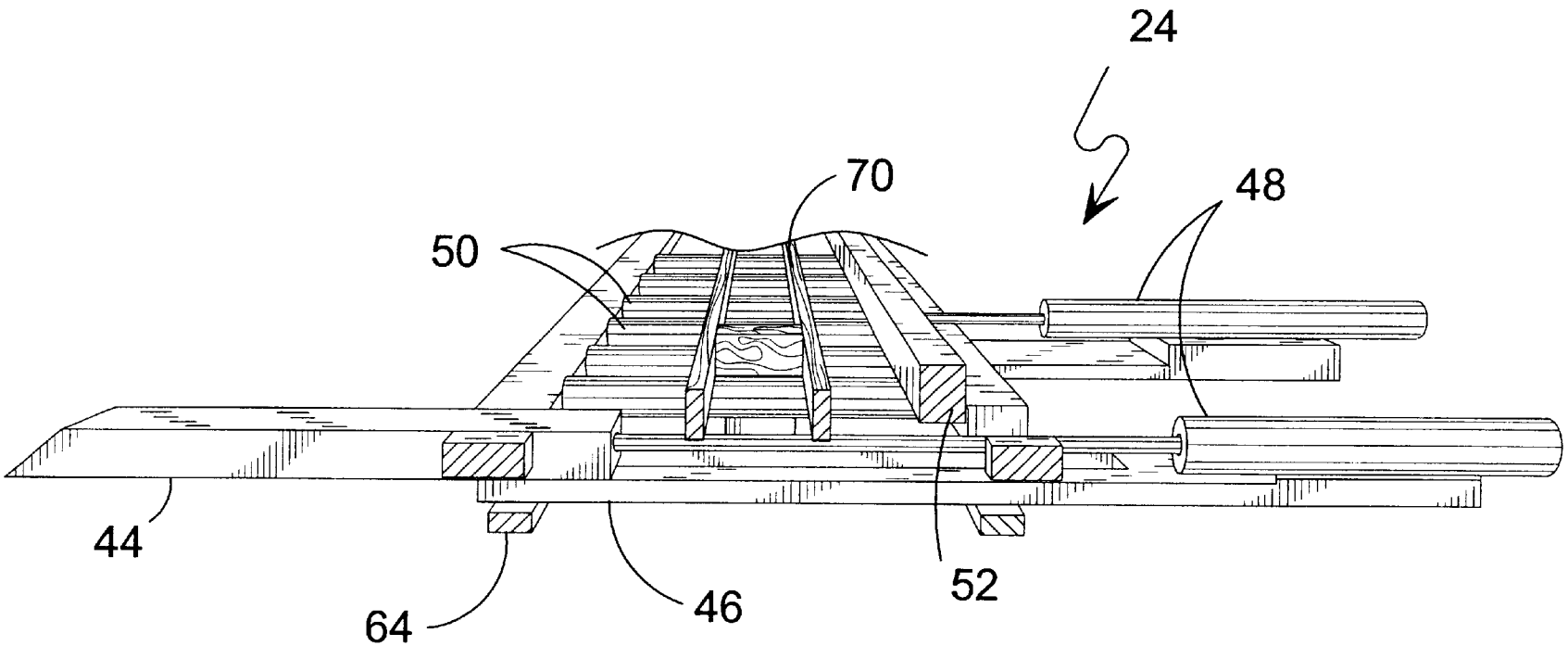
FIG. 9 is a sectional view of the present invention in operation.

Turning to FIG. 9, shown therein is a sectional view of the present invention in operation. Shown is the present invention with a final product or work piece 70 placed on the stacking system portion 24 of the present invention ready to be pushed by the displacement bar 52 onto the stacking arm 44. Other elements previously disclosed are also shown.

Figure 10:
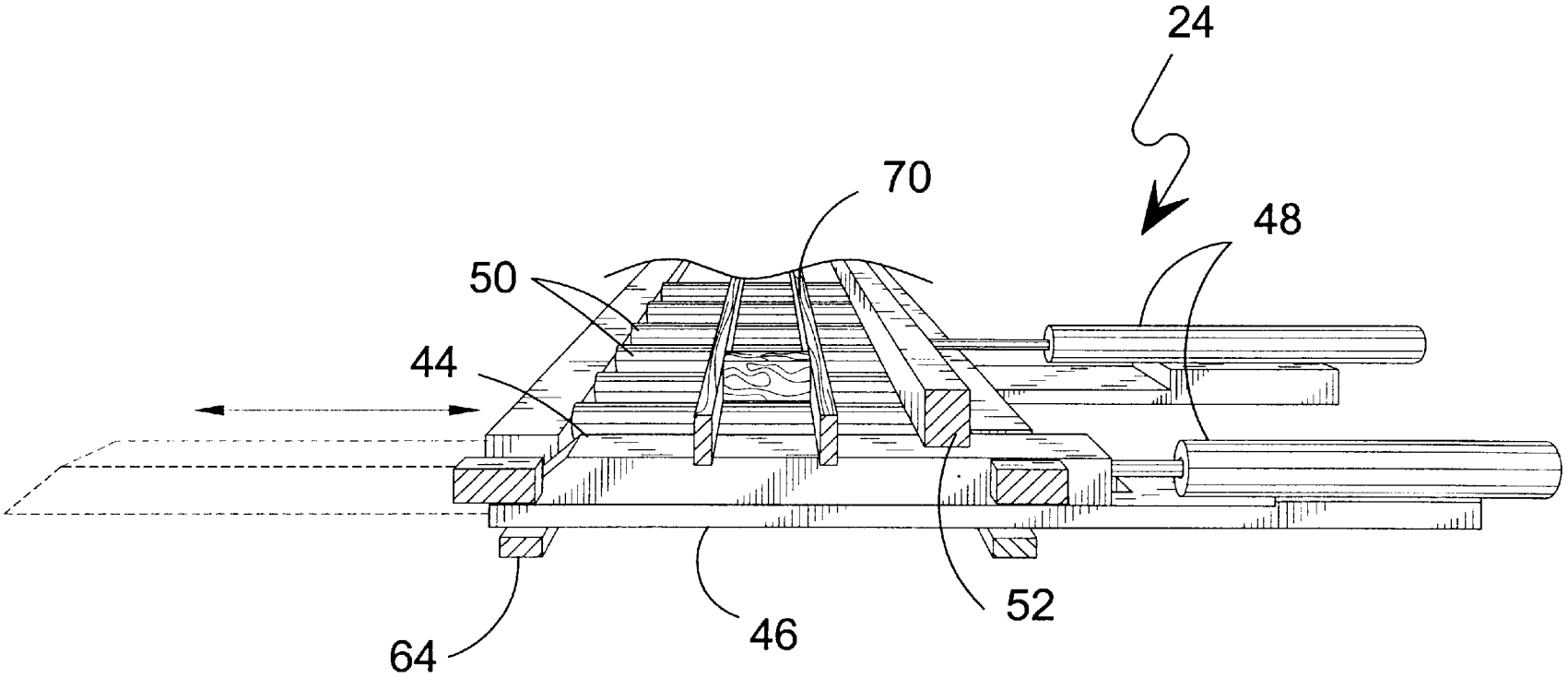
FIG. 10 is a sectional view of the stacking portion retracted.

Turning to FIG. 10, shown therein is a sectional view of the stacking portion 24 in a retracted position. Shown is the present invention's stacking portion having its stacking arm 44 in the retracted position. Other elements previously disclosed are also shown.

Figure 11:
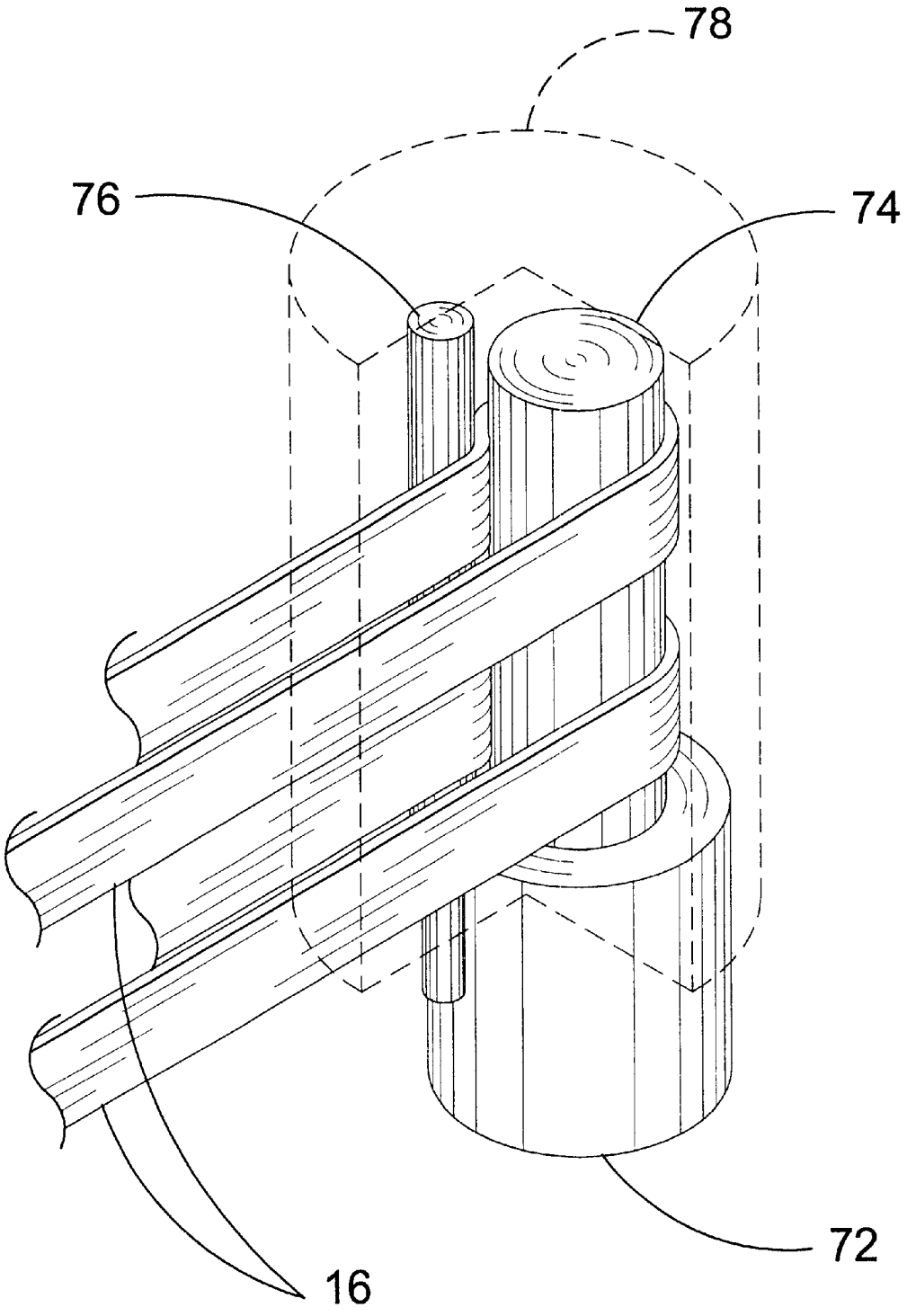
FIG. 11 is a sectional view of the conveyer system.

Turning to FIG. 11, shown therein is a sectional view of the conveyer system. Shown is the system of moving the side conveyer belts 16 along the sides of the compression members with the system having a plurality of motors 72 to turn the conveyer belt's drive shaft 74 and a plurality of spindles 76 to guide them, along with a cowl 78.

Figure 12:
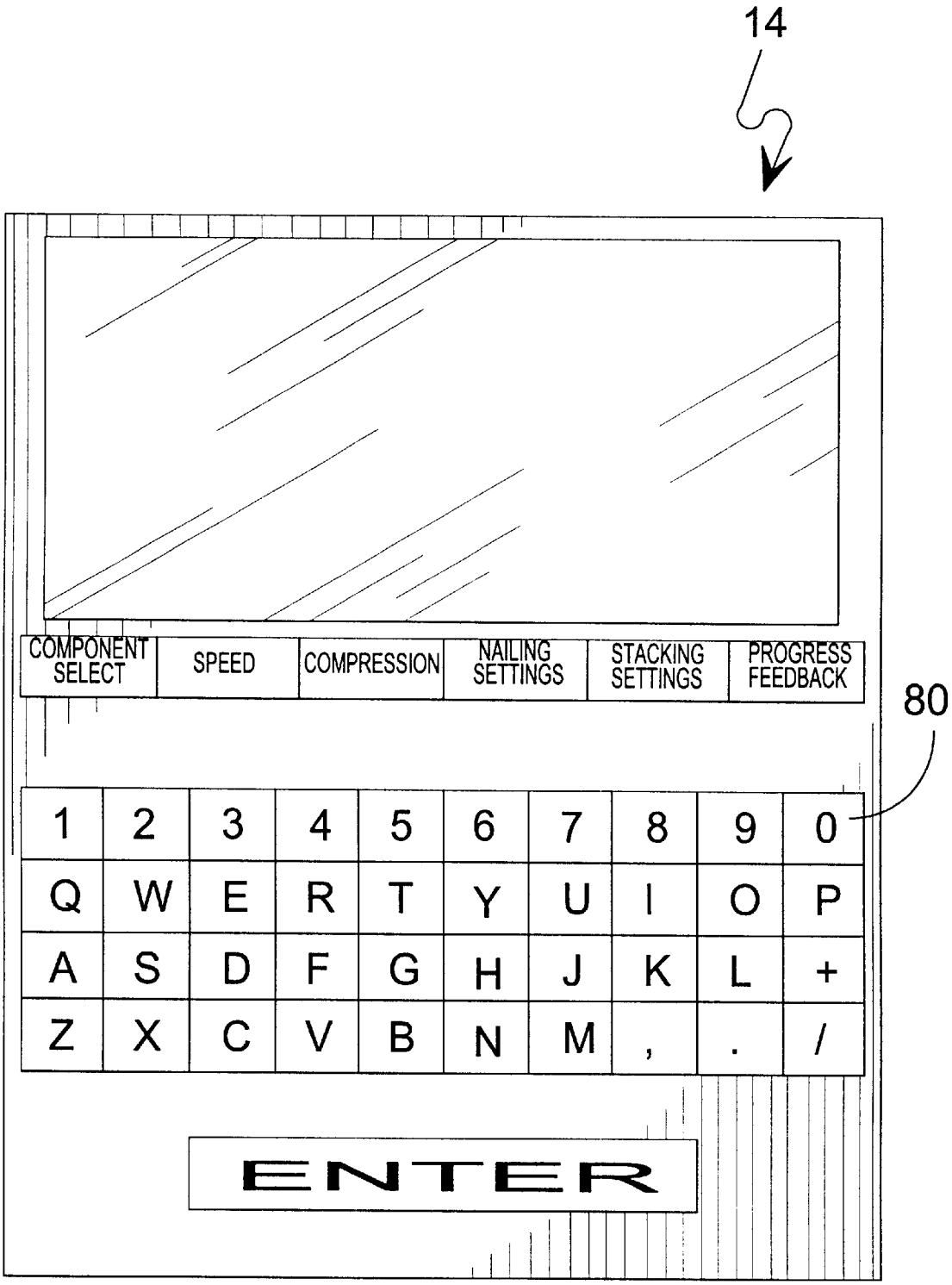
FIG. 12 is a sectional view of the control panel.

Turning to FIG. 12, shown therein is a front view of the control panel 14. Shown is the control panel surface with a plurality of buttons 80 with multiple functions labeled on them that can be performed by the present invention.

Figure 13:
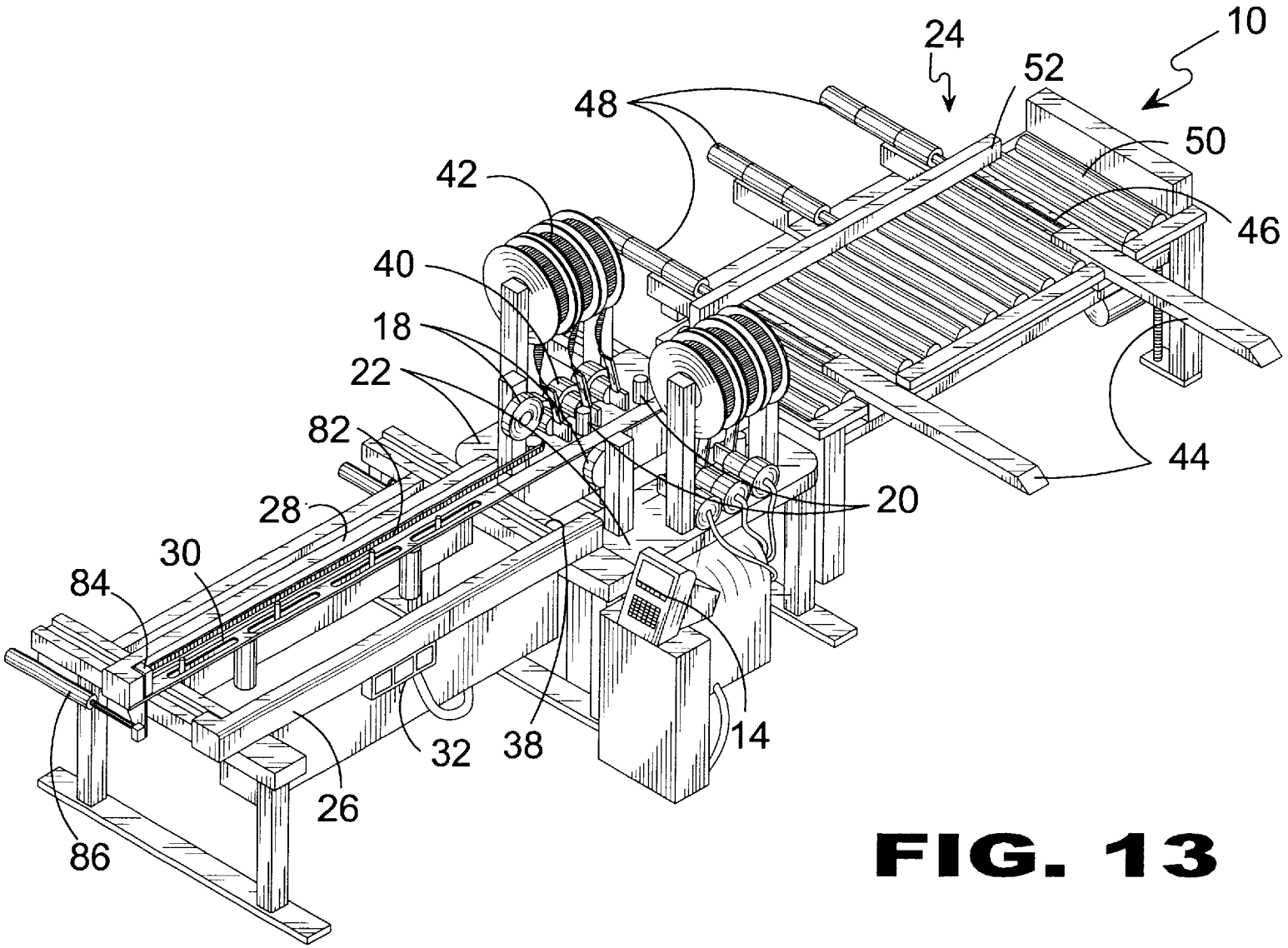
FIG. 13 is a perspective view of the present invention.

Turning to FIG. 13, shown therein is a perspective view of an alternative design of the present invention 10. Shown is the present invention having a plurality of side conveyer chains 82 having squaring stops 84 with a pneumatic piston 86 to better position raw materials, that work in conjunction with the upper 18 and side 20 rollers to produce movement of the raw material past the nailing system 22 where nailing can take place and then be moved to the stacking system 24 where the finished product is stacked. Other elements previously disclosed are also shown.

Figure 14:
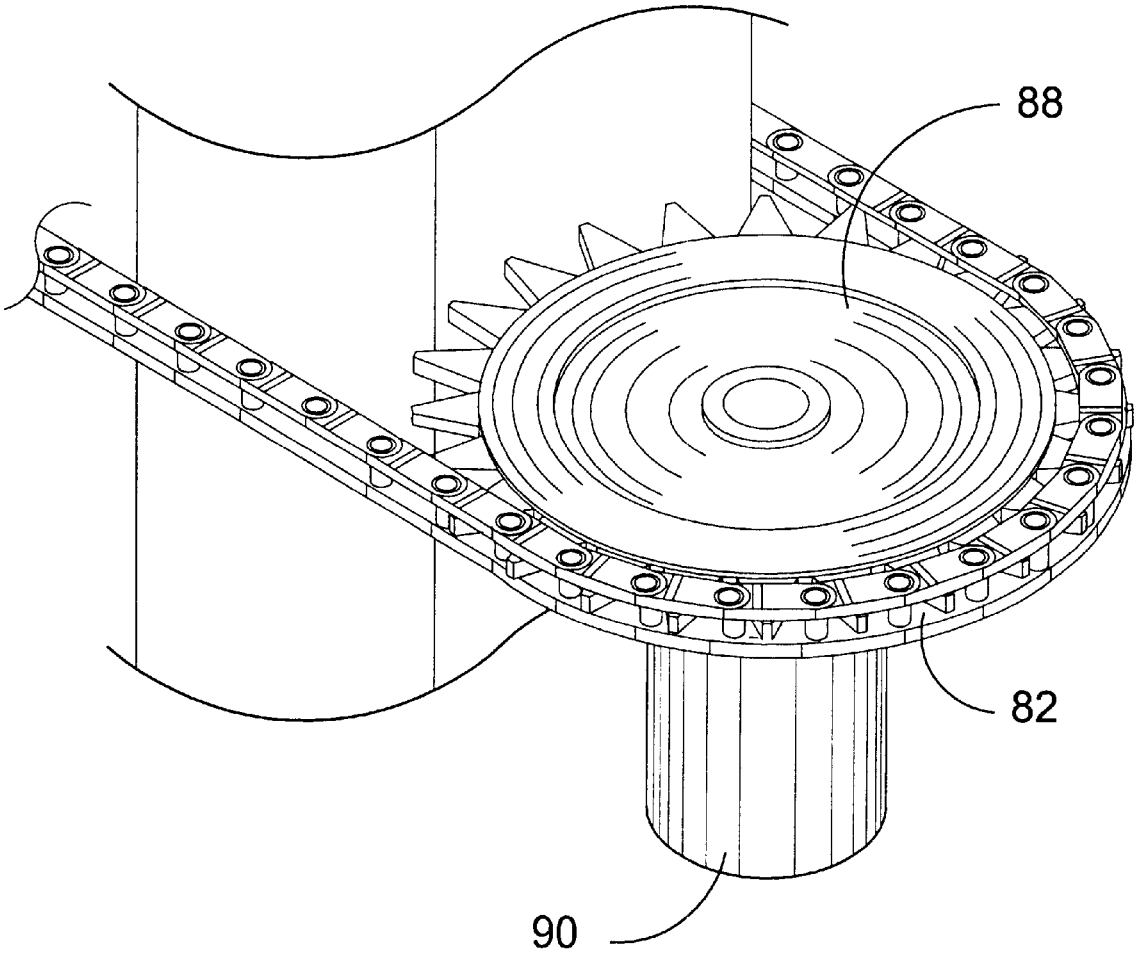
FIG. 14 is a detailed view of an alternate embodiment.

Turning to FIG. 14, shown therein is a detailed view of an alternate embodiment. Shown is the present invention having a chain conveyer 82 used for the transportation of raw materials to the nail guns with the chain conveyer having a planer gear 88 and motor 90 as a driving force.

Figure 15:
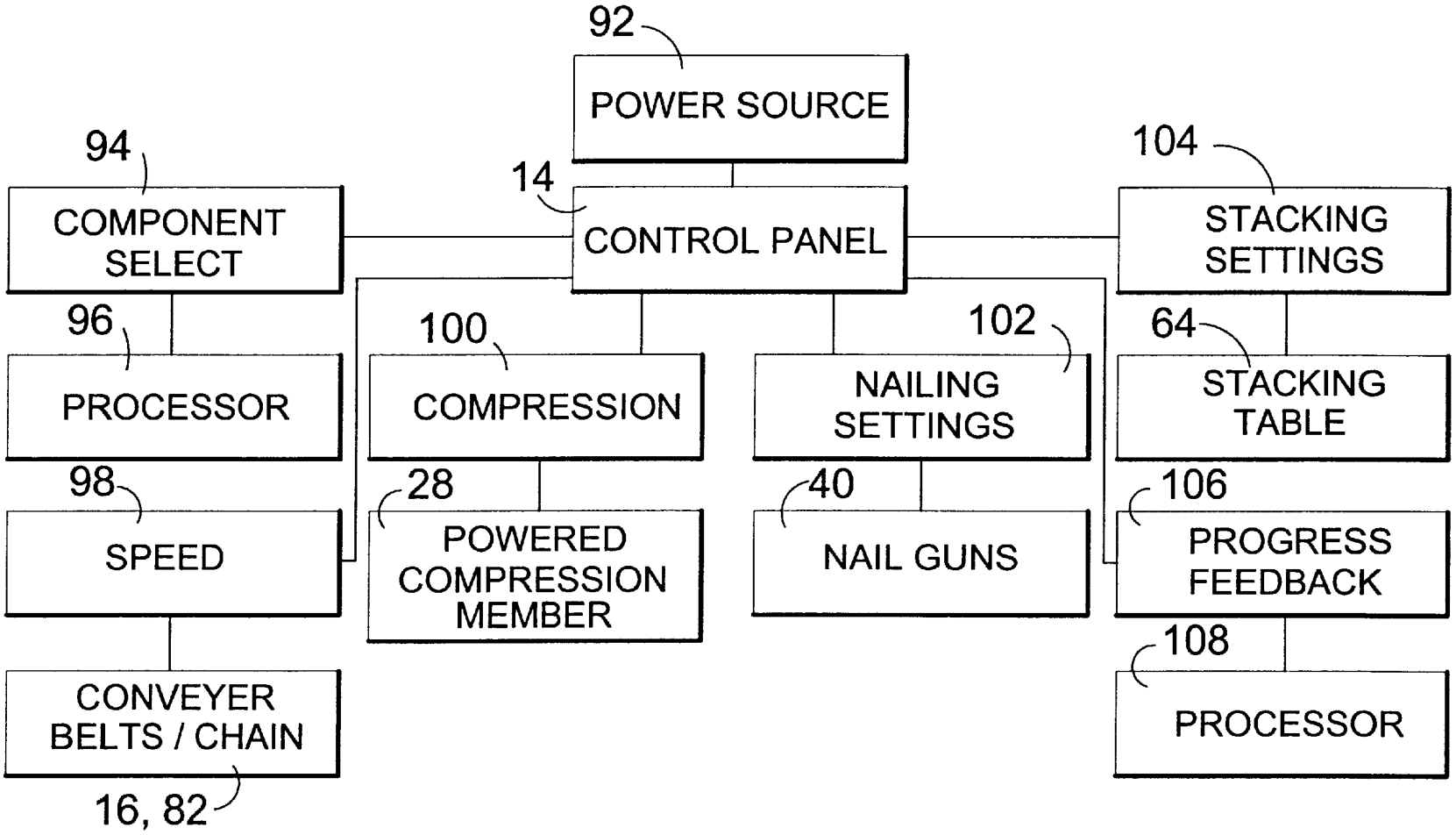
FIG. 15 is a flow chart of the present invention.

Turning to FIG. 15, shown therein is a flow chart of the present invention. Shown are the various operations of the present invention and how they are interrelated to the various components of the present invention. Shown therein is a power source 92 with control panel 14, the component selector 94 with processor 96; also shown is the conveyor belt/chain control 16, 18 with speed selector 98. Also shown is the powered compression control 28 for compression 100 along with the nail guns 40 and nail settings 102. Also shown is the stacking table control 64 and stacking settings 104 with a feedback controller 106 and processor 108.

We claim:

1. An apparatus for assembling finished wood workpieces, comprising:

a) means for loading the workpieces into the apparatus whereby the workpieces are positioned for further processing, said means for loading comprising:

a stationary compression member, said stationary member being substantially horizontal, said stationary member being elongated;

a movable compression member, said movable member being substantially parallel to said stationary member to permit workpieces to be fixedly held between the stationary member and the movable member;

at least a pair of compression member tracks disposed perpendicular to said movable compression member to permit the movable compression member to move on said compression member tracks toward and away from said stationary compression member to fixedly hold a workpiece therein between;

means for moving said movable compression member along said pair of compression member tracks;

means for moving a workpiece longitudinally along said stationary compression member and said movable compression member to permit the workpiece to be moved toward a means for nailing;

b) means for nailing the workpieces together whereby the workpieces are nailed together and readied for further processing;

c) means for stacking the workpieces whereby the finished workpieces are properly stacked;

d) a horizontal support frame, said frame having a plurality of upright standing legs thereon to permit the means for loading, the means for nailing and means for stacking to be individually supported; and, e) means for controlling the means for loading, means for nailing and means for stacking the workpieces whereby the apparatus is properly controlled.

2. The apparatus of claim 1, wherein said means for moving said movable compression member along said pair of compression member tracks comprises at least one ball screw attached to said movable compression member to permit the movable compression member to move, and a motor to turn said ball screw.

3. The apparatus of claim 2, wherein said means for moving a workpiece along said compression members comprises:

a) a side conveyor belt disposed longitudinally along said movable compression member to permit said belt to contact a workpiece and thereby frictionally move the workpiece;

b) a guide track to receive a workpiece and to permit support to the workpiece;

c) a plurality of positioning rollers to aid in placement of the work piece on the guide track;

d) at least one pneumatic cylinder attached to said guide track to permit the guide track to be raised or lowered;

e) a guide control to permit control of said pneumatic cylinder; and f) drive means for said side conveyor belt whereby the side conveyor belt is driven.

4. The apparatus of claim 3, wherein said drive means for said side conveyor belt comprises:

a) a drive shaft disposed on an end of said belt to permit the belt to move;

b) a motor to turn said drive shaft;

c) at least one spindle to guide said side conveyor belt; and d) a cowl to cover said drive shaft and spindle.

5. The apparatus of claim 2, wherein said means for moving a workpiece along said compression members comprises:

a) a side conveyor chain disposed longitudinally along said movable compression member to permit said chain to contact a workpiece and thereby frictionally move the workpiece;

b) a guide track to receive a workpiece and to permit support to the workpiece;

c) a plurality of positioning rollers to aid in placement of the work piece on the guide track;

d) at least one pneumatic cylinder attached to said guide track to permit the guide track to be raised or lowered;

e) a guide control to permit control of said pneumatic cylinder; and, f) drive means for said side conveyor belt whereby the side conveyor belt is driven.

6. The apparatus of claim 5, wherein said drive means for said side conveyor belt comprises:

a) a planer gear disposed on an end of said chain to permit the chain to move; and b) a motor to turn said planer gear.

7. The apparatus of claim 6, wherein said means for nailing the workpiece comprises:

a) a pair of pneumatic nail guns to permit the workpiece to be nailed;

b) wherein one nail gun is mounted on said movable compression member to permit the nail gun to move in concert with the movable compression member, and an opposing nail gun is mounted in alignment with said stationary compression member to permit nailing in proper alignment with the stationary compression member;

c) a nail supply for each nail gun to permit a sufficient supply of nails;

d) a nail belt for each nail gun to permit the nails to be transported to the nail gun; and, e) a nail belt guide for each nail gun to permit the nails to be properly aligned with the workpiece.

8. The apparatus of claim 7, further comprising:

a) an upper positioning roller to aid in proper alignment of the workpieces with said nail gun;

b) a side positioning roller to aid in proper alignment of the workpiece with said nail gun; and, c) an air supply to permit operation of said pneumatic nail guns.

9. The apparatus of claim 8, wherein said means for stacking comprises:

a) an elongated, horizontal stacking table for receiving finished workpieces;

b) a plurality of rollers disposed on said stacking table to permit finished work pieces to roll thereon;

c) a plurality of ball screws vertically disposed under said stacking table to permit said stacking table to be raised or lowered; and, d) a motor connected to said ball screws to permit rotation of said ball screws necessary for said ball screws to function.

10. The apparatus of claim 9, wherein said stacking table further comprises:

a) at least two stacking arms disposed on a first side of said stacking table to permit the finished product to be stacked;

b) a stacking arm track upon which each of said stacking arm moves; and, c) a first pneumatic cylinder connected to each of said stacking arms to permit said stacking arms to be moved.

11. The apparatus of claim 10, wherein said first pneumatic cylinder is disposed on a second side of said stacking table, said first pneumatic cylinder having an arm connected to each of said stacking arms.

12. The apparatus of claim 11, wherein said stacking table further comprises a displacement arm disposed on a second side of said stacking table to permit finished product to be moved toward said stacking arm.

13. The apparatus of claim 12, wherein said displacement arm further comprises a second pneumatic cylinder connected thereto to permit said displacement arm to be moved toward the stacking arms.

14. The apparatus of claim 10, wherein said means for controlling comprises:

a) a control box for housing a controller;

b) a plurality of buttons for providing a plurality of functions to be controlled;

c) a component selector to permit selection of the type of component to be processed;

d) a speed selector to permit selection of the speed at which the apparatus will function;

e) a compression selector to permit selection of the degree of compression a work piece is to receive;

f) a nailing selector to permit selection of the type of nailing to provide;

g) a stacking selector to permit selection of the type of stacking to provide; and, h) a process feedback selector to permit review of the operation of the apparatus.

15. An apparatus for assembling wood workpieces comprising:

a loading station for loading wooden components of at least one of the workpieces at a time into the apparatus, the loading mechanism including first and second compression members mounted for relative movement between an open position in which the compression members are farther apart and a closed position in which the compression members are closer together for compressing the wooden components between the first and second compression members, and a conveyor system configured to move the workpiece longitudinally along said first and second compression members in said closed position;

a nailing station arranged to receive wooden components from the loading station and to nail at least some of the wooden components of the workpiece together; and a receiving station for receiving the workpiece from the nailing station.

16. The apparatus of claim 15 wherein at least a portion of the conveyor system is associated with one of the compression members.

17. The apparatus of claim 16 wherein said one compression member is movable between the open and closed positions of the compression members, the conveyor system being movable with said one compression member.

18. The apparatus of claim 17 wherein another of the compression members is stationary.

19. The apparatus of claim 17 wherein the conveyor system comprises at least one conveyor belt and a motor for driving the conveyor belt.

20. The apparatus of claim 17 wherein the conveyor system comprises at least one conveyor chain and a motor for driving the conveyor chain.

21. The apparatus as set forth in claim 16 wherein the conveyor system further comprises a guide track to support the workpiece and a plurality of positioning rollers.

22. The apparatus of claim 15 further comprising a stacking mechanism for stacking the workpieces, and a control panel for controlling the apparatus.

23. Apparatus for loading wooden components of a workpiece and feeding the components for further processing, the apparatus comprising first and second compression members mounted for relative movement between an open position in which the compression members are farther apart and a closed position in which the compression members are closer together for compressing the wooden components between the first and second compression members, and a conveyor system configured to move the workpiece longitudinally along said first and second compression members in said closed position.

24. The apparatus of claim 23 wherein at least a portion of the conveyor system is associated with one of the compression members.

25. The apparatus of claim 24 wherein said one compression member is movable between the open and closed positions of the compression members, the conveyor system being movable with said one compression member.

26. The apparatus of claim 25 wherein another of the compression members is stationary.

27. The apparatus of claim 25 wherein the conveyor system comprises at least one conveyor belt and a motor for driving the conveyor belt.

28. The apparatus of claim 25 wherein the conveyor system comprises at least one conveyor chain and a motor for driving the conveyor chain.

29. The apparatus as set forth in claim 24 wherein the conveyor system further comprises a guide track to support the workpiece and a plurality of positioning rollers.

30. The apparatus of claim 23 further comprising a stacking mechanism for stacking the workpieces, and a control panel for controlling the apparatus.

* * * * *